US005894695A

United States Patent [19]

Stellatos

[11] Patent Number: 5,894,695

[45] Date of Patent: Apr. 20, 1999

[54] TREE WATERING DEVICE

[76] Inventor: Andrew Stellatos, 55 Large Ave., Hillsdale, N.J. 07642

[21] Appl. No.: 09/002,933

[22] Filed: Jan. 5, 1998

[51] Int. Cl.[6] ..... A47G 7/02; F16K 31/18

[52] U.S. Cl. ..... 47/40.5; 137/433

[58] Field of Search ..... 47/40.5; 137/433

[56] References Cited

U.S. PATENT DOCUMENTS

| | | | |
|---|---|---|---|
| 2,646,060 | 7/1953 | Ponsar | 137/433 |
| 2,938,304 | 5/1960 | Thomas et al. | 47/40.5 |
| 4,850,137 | 7/1989 | Foster | 47/79 |
| 4,997,013 | 3/1991 | Peckels | 141/95 |
| 5,076,009 | 12/1991 | Cibor | 47/40.5 |
| 5,090,443 | 2/1992 | Jacobsen | 137/429 |
| 5,349,997 | 9/1994 | Rial | 141/331 |
| 5,410,839 | 5/1995 | Granger | 47/40.5 |
| 5,473,838 | 12/1995 | Denbigh | 47/40.5 |
| 5,493,277 | 2/1996 | Pierce et al. | 340/620 |
| 5,513,677 | 5/1996 | McCurry | 141/1 |
| 5,522,179 | 6/1996 | Hollis | 47/40.5 |
| 5,535,547 | 7/1996 | Brunengo | 47/40.5 |
| 5,615,516 | 4/1997 | Brown | 47/40.5 |
| 5,661,926 | 9/1997 | Granger | 47/40.5 |
| 5,791,083 | 8/1998 | Giangrossi | 47/40.5 |
| 5,799,437 | 9/1998 | Evans et al. | 47/40.5 |
| 5,809,691 | 9/1998 | Frantz | 47/40.5 |

*Primary Examiner*—Michael J. Carone
*Assistant Examiner*—Frederick T. French, III
*Attorney, Agent, or Firm*—Richard A. Joel, Esq.

[57] ABSTRACT

A tree watering device comprises a funnel having an aperture at one end coupled to an elongated tubing which extends horizontally for a predetermined distance and then downwardly into a tree stand which contains water for the base of a tree mounted therein. The hollow tubing includes an aperture in the wall thereof in the portion mounted within the stand and a C-shaped element protruding through the wall of the tubing opposite the aperture. The C-shaped element restricts the movement of a float between the legs which protrude through the wall. The aperture emits a gurgling sound when water is poured into the funnel until the water level rises causing the float to cover the hole causing the gurgling to cease and indicating that it is time to cease adding water.

6 Claims, 1 Drawing Sheet

FIG. 1
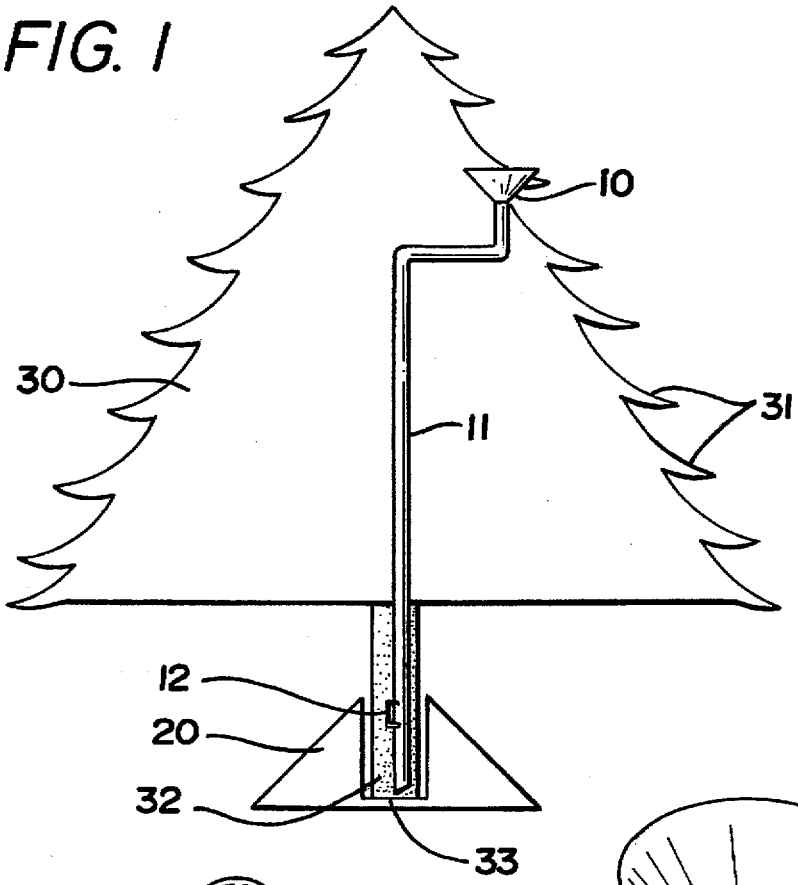
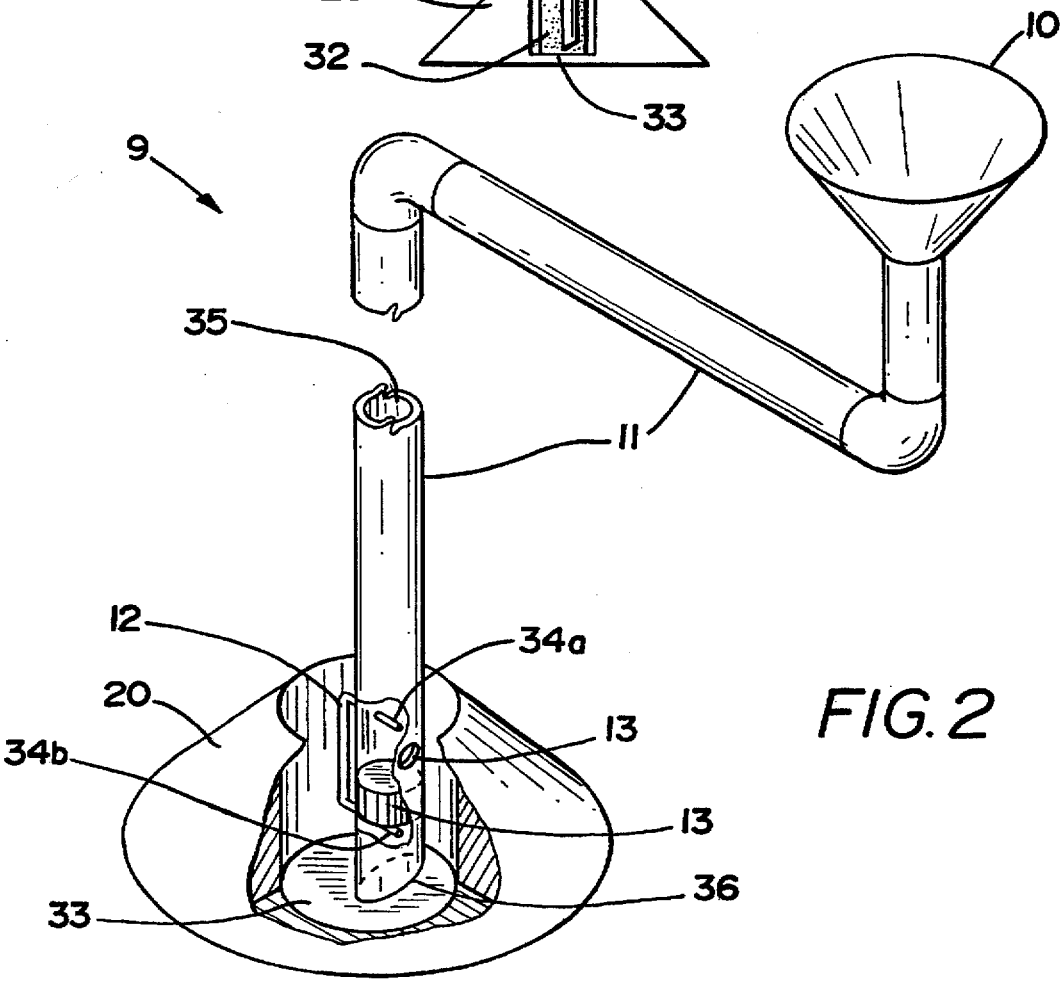
FIG. 2

TREE WATERING DEVICE

BACKGROUND OF THE INVENTION

This invention relates to tree watering devices particularly devices which are useful to water Christmas trees and which are convenient to use and eliminate the spillage of water.

In the invention, water is poured into the tree watering device which emits a sound such as gurgle when water is poured. The sound diminishes as the tree stand fills with water and a float covers a sound producing aperture and the tube which leads to the intake funnel.

U.S. Pat. No. 4,850,137 to Foster, discloses a device for watering and removing water from cut plant containers. The device includes a suction bulb funnel and a tube. Another prior art patent to Peckles (U.S. Pat. No. 4,997,013), discloses a liquid fill level indicator which includes a whistle to indicate a point where one is to stop filling. Air escaping during the filling operation causes the indicator to whistle. Also of interest is U.S. Pat. No. 5,535,547 to Brunengo which discloses a conduit and float gauge apparatus for Christmas trees. The float assembly is mounted with the conduit unit and includes a riser unit connected to a floatation member with a gauge assembly on the upper end of said riser unit.

Finally, U.S. Pat. No. 5,410,839 to Granger discloses a Christmas tree water funnel with an indicating light and a float which activates the light when the water reaches a predetermined level. The prior art, while of interest, does not disclose the unique gurgling apparatus proposed herein which is economical to manufacture and yet functions extremely well to guide the watering of Christmas trees in the home. Use of the device is convenient and eliminates spillage.

SUMMARY OF THE INVENTION

This invention relates to tree watering devices and in particular to devices for watering Christmas trees.

A funnel is coupled to tubing which extends horizontally to a point within the tree branches and then vertically downward to the tree stand where the base of the tree is mounted. The device extends downwardly into the tree stand terminating a predetermined distance above the base.

The vertical tubing includes a C-shaped element having legs extending through the walls of the tubing to capture a float. The C-shaped element is mounted slightly below the upper portion of the stand. The float is located within the legs of the C-shaped element while an aperture in the opposite wall is also positioned within the legs. The float rises as water is poured into the funnel flowing downwardly into the stand. The aperture causes a gurgling sound with the water flowing past the aperture into the stand where the base of the tree is mounted. The gurgling sound lessens as the stand fills with water until finally the gurgling ceases with the float blocking the hole indicating that the maximum amount of water is now in the stand. The individual then ceases pouring water into the funnel.

Accordingly, an object of this invention is to provide a new and improved indoor tree watering device.

Another object of this invention is to provide a new and improved tree watering device which indicates the level of fill in a tree stand by emitting a gurgling sound which decreases as the water fills the stand.

A more specific object of this invention is to provide a Christmas tree watering device which includes a funnel leading to a vertically extending tubing having an aperture in the lower portion thereof to emit a sound as the water is poured into the base from the funnel end.

A further object of this invention is to provide a new and improved tree watering device wherein the tubing extends into a tree stand and includes a C-shaped element which captivates a float within the tubing opposite the aperture to cause the aperture to cease emitting a sound as the float covers said aperture when the water level rises to a point a predetermined distance below the top of the stand.

BRIEF DESCRIPTION OF THE DRAWINGS

The above and other objects and advantages of this invention may be more clearly seen when viewed in conjunction with the accompanying drawings wherein:

FIG. 1 is a schematic view of the watering device utilized within a stand having a tree mounted therein; and, FIG. 2 discloses tubing having a funnel at one end and a hole extending through the side wall thereof at a lower end to provide a gurgling sound and a C-shaped element having legs protruding through the wall opposite the hole and a float which moves between the legs to cover the aperture when the water level has risen.

DETAILED DESCRIPTION OF THE INVENTION

Referring now to the drawings, this invention pertains to a tree watering device and in particular to a device for watering Christmas trees 30 which is easy to use and prevents spillage of the water.

It is widely known that Christmas trees dry out rapidly and constitute a safety hazard. This drying process can be delayed and the tree kept fresh by constant watering. Many people, however, are dissuaded from watering the tree by the difficulty in reaching under the branches to place the water in the stand. The use of hoses helps but it is difficult to judge the height of water in the stand and spillage results.

The device 9 comprises a funnel 10 which is mounted to elongated plastic tubing 11 extending horizontally therefrom and then vertically downward into the tree stand 20. The tubing 11 is flexible and may be appropriately hidden in the tree branches 31 and also colored to match the tree 30. The tubing is cut at an angle at its base 36 so that the water is not blocked by the stand. The tree stand 20 includes the lower portion 32 of a Christmas tree mounted therein with the tubing 11 extending downwardly into the stand 20 a predetermined distance above the bottom 33 of the tree stand 20.

A C-shaped element 12 is mounted to the wall of the tubing 11 with the legs **34*a* and 34*b* extending inwardly across the hollow portion 35 of the tube 11. An aperture 13 is located in the opposite wall to provide a gurgling sound as water is poured into the funnel. The legs of the C-shaped element 12** restrict the movement of a float which moves upwardly and downwardly between the legs.

As water is poured into the funnel 10 a gurgling noise is created with the aperture 13. When the water reaches a predetermined level, the float 13 which is maintained between the legs of the C-shaped element 12 reaches a position adjacent the aperture 13 the gurgling ceases. The gurgling decreases before it ceases entirely so that one can readily stop filling the funnel.

While the invention has been explained by a detailed description of certain specific embodiments, it is understood that various modifications and substitutions can be made in any of them within the scope of the appended claims which are intended also to include equivalents of such embodiments.

What is claimed, is:

1. A watering device for trees having a base mounted in a stand wherein the device provides a warning to prevent overfilling of the stand comprising:

a stand having a recessed water-tight recess in which the base of a tree is mounted;

plastic tubing to convey water extending into the recess at one end, upwardly within the tree and then outwardly for proposes of accessibility and including a funnel mounted at the end;

a C-shaped member mounted to the tubing within the stand with the legs of the C-shaped member extending through the walls of the tubing;

a float mounted within the legs of the C-shaped member to move upwardly and downwardly depending on the fluid level, said tubing having an aperture in the wall opposite the C-shaped member, wherein water poured into the tubing causes a gurgling sound as it passes the aperture and then ceases to gurgle when the float rises to cover the aperture indicating that the watering should stop.

2. A watering device for trees having a base mounted in a stand wherein the device provides a warning to prevent overfilling of the stand in accordance with claim 1 wherein:

the plastic tubing within the recess is cut at an angle at its end to permit a ready flow of water at the end of said tubing.

3. A watering device for trees having a base mounted in a stand wherein the device provides a warning to prevent overfilling of the stand in accordance with claim 1 wherein:

the plastic tubing includes a funnel mounted at its upper end to facilitate pouring of water therein, said funnel being detachable.

4. A watering device for trees having a base mounted in a stand wherein the device provides a warning to prevent overfilling of the stand in accordance with claim 2 wherein:

the leg of the C-shaped element extend perpendicular to the wall of the tubing and through said tubing to a predetermined distance from the opposite wall.

5. A watering device for trees having a base mounted in a stand wherein the device provides a warning to prevent overfilling of the stand in accordance with claim 2 wherein:

the C-shaped element is positioned a predetermined distance below the top of the stand so that the stand will not overflow from the water in the tubing if the filling ceases upon cessation of the gurgling.

6. A watering device for trees having a base mounted in a stand wherein the device provides a warning to prevent overfilling of the stand in accordance with claim 1 wherein:

the tubing extends vertically upward within the tree, outwardly at a right angle and then vertically upward for filling purposes.

* * * * *